US005364753A

United States Patent [19]

Yamazaki et al.

[11] Patent Number: 5,364,753

[45] Date of Patent: * Nov. 15, 1994

[54] SILVER HALIDE COLOR PHOTOGRAPHIC LIGHT-SENSITIVE MATERIAL

[75] Inventors: Katsumasa Yamazaki, Hachioji; Shuichi Sugita, Kunitachi; Shigeto Hirabayashi, Hino, all of Japan

[73] Assignee: Konica Corporation, Tokyo, Japan

[ * ] Notice: The portion of the term of this patent subsequent to Dec. 14, 2010 has been disclaimed.

[21] Appl. No.: 942,468

[22] Filed: Sep. 9, 1992

[30] Foreign Application Priority Data

Sep. 25, 1991 [JP] Japan ..... 3-273424

[51] Int. Cl.[5] ..... G03C 7/333; G03C 7/384

[52] U.S. Cl. ..... 430/549; 430/554; 430/555; 430/359

[58] Field of Search ..... 430/554, 555, 549, 359

[56] References Cited

U.S. PATENT DOCUMENTS

| | | | |
|---|---|---|---|
| 4,070,191 | 1/1978 | Imamura et al. | 430/549 |
| 5,219,719 | 6/1993 | Kida | 430/555 |
| 5,270,156 | 12/1993 | Hirabayashi et al. | 430/555 |

FOREIGN PATENT DOCUMENTS

| | | | |
|---|---|---|---|
| 2415132 | 10/1974 | Denmark . | |
| 0456433 | 11/1991 | European Pat. Off. . | |
| 2336711 | 12/1976 | France . | |
| 2658573 | 7/1977 | Germany . | |
| 1044778 | 10/1966 | United Kingdom | 430/555 |
| 1552701 | 9/1979 | United Kingdom | 430/555 |

OTHER PUBLICATIONS

European Search Report dated Feb. 18, 1993.

*Primary Examiner*—Lee C. Wright
*Attorney, Agent, or Firm*—Finnegan, Henderson, Farabow, Garrett & Dunner

[57] ABSTRACT

There is provided a silver halide color photographic light-sensitive material improved in sensitivity, color reproduction and image lasting quality. The color photographic material contains a magenta coupler [M-I] and a colored coupler [CM-I] represented by the following formulas:

[M-I]

[CM-I]

7 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, particularly to a silver halide color photographic light-sensitive material having a high sensitivity, an excellent color reproducibility and an excellent keeping stability of color images.

BACKGROUND OF THE INVENTION

The three primary colors by the subtractive color process are now used in silver halide color photographic materials, and color images are formed by combination of three dyes derived from a yellow coupler, a magenta coupler and a cyan coupler.

As magenta couplers used in conventional silver halide color photographic materials, pyrazolone type, pyrazolinobenzimidazole type or indanone type couplers are known, especially a variety of 5-pyrazolone derivatives are widely employed.

As a substitutent at the 3-position of the 5-pyrazolone ring of such 5-pyrazolone derivatives, there is used, for example, an alkyl group or an aryl group, the alkoxy group described in U.S. Pat. No. 2,439,098, the acylamino group described in U.S. Pat. Nos. 2,369,489 and 2,600,788, or the ureido group described in U.S. Pat. No. 3,558,319. These couplers, however, have defects in that they cannot provide high density magenta dye images due to their low coupling activities with an oxidation product of a developing agent, and in that magenta dye images formed by color development have a large secondary absorption in the blue light region and their primary absorptions are not sharp in the long wavelength region.

The 3-anilino-5-pyrazolone type couplers disclosed in U.S. Pat. Nos. 2,311,081, 3,677,764, 3,684,514 and British Pat. Nos. 956,261, 1,173,513 have a high coupling activity and a high color forming property, in addition to the advantage that useless absorption in the red light region is small. However, the primary absorption of these existing 3-anilino-5-pyrazolone type couplers is in a relatively short wavelength region. Therefore, when these are used in a color nagative silver halide photographic light-sensitive material, color reproducibility in printing is lowered, and large yellow stains appear on non-colored portions of a processed light-sensitive material in a long-term storage under high humidity conditions.

Various studies have been made to remove such defects. For example, Japanese Pat. O.P.I. Pub. No. 80027/1977 proposes use of 1-pentahalogenophenyl-3-anilino-5-pyrazolone type couplers. These couplers have a high coupling activity, a high color forming property and a good spectral property, but are low in dispersion stability because of their low solubilities in high-boiling organic solvents and, thereby, are liable to deposit as crystals while these are made into a dispersion or stored as a dispersion. In addition, these have a defect that magenta dye images formed by color development are unstable and undergo a large density change in the course of a long-term storage under high humidity conditions.

SUMMARY OF THE INVENTION

The first object of the present invention is to provide a silver halide color photographic light-sensitive material high in sensitivity and excellent in printing color reproduction.

The second object of the present invention is to provide a silver halide color photographic light-sensitive material excellent in dye image stability.

The third object of the present invention is to provide a silver halide color photographic light-sensitive material using a coupler dispersion excellent in dispersion stability and free from deposition of coupler crystals.

The objects of the invention are attained by a silver halide color photographic light-sensitive material having on a support at least one silver halide emulsion layer, wherein said silver halide emulsion layer contains at least one of the magenta couplers represented by the following Formula [M-I] and at least one of the colored magenta couplers represented by the following Formula [CM-I].

Formula [M-I]

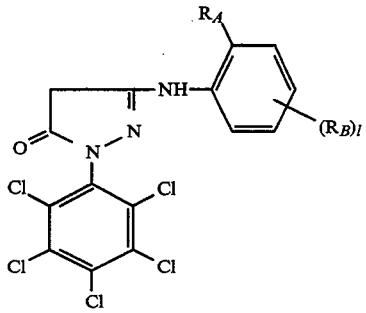

wherein $R_A$ represents a halogen atom or an alkoxy group; $R_B$ represents an acylamino group, a sulfonamido group, an imido group, a carbamoyl group, a sulfamoyl group, an alkoxycarbonyl group, an alkoxycarbonylamino group or an alkoxy group; a represents an integer of 0 to 4.

Formula [CM-I]

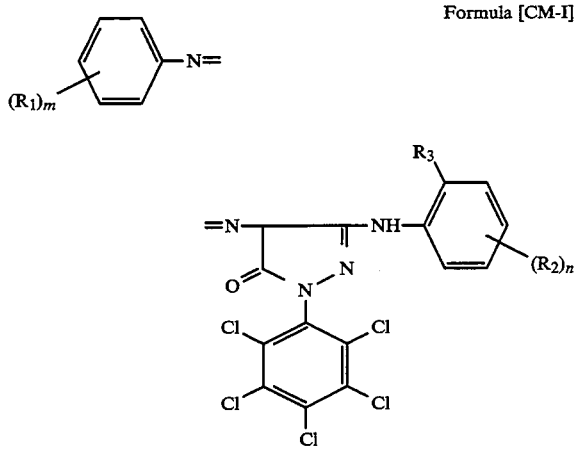

wherein $R_1$ represents a substituent, $R_2$ represents an acylamino group, a sulfonamido group, an imido group, a carbamoyl group, a sulfamoyl group, an alkoxy group, an alkoxycarbonyl group or an alkoxycarbonylamino group; $R_3$ represents a halogen atom or an alkoxy group; m represents an integer of 0 to 5; and n represents an integer of 0 to 4.

DETAILED DESCRIPTION OF THE INVENTION

First, the magenta coupler of the invention represented by Formula [M-I] (hereinafter referred to as magenta coupler [M-I]) is described.

In Formula [M-I], the halogen atom represented by $R_A$ includes, for example, a chlorine atom, a bromine atom and a fluorine atom; the alkoxy group so-represented includes, for example, a methoxy group and a dodecyloxy group. Of them, a preferred $R_A$ is a chlorine atom.

The amino group represented by $R_B$ includes, for example, a 2,4-di-t-pentylphenoxyacetamido group, 4-(2,4-di-t-pentylphenoxy)butaneamido group; the sulfonamido group includes, for example, a 4-dodecyloxyphenylsulfonamido group; the imido group includes, for example, an octadecenylsuccinimido group; the carbamoyl group includes, for example, a 4-(2,4-di-t-pentylphenoxy)butylaminocarbonyl group; the sulfamoyl group includes, for example, a tetradecanesulfamoyl group; the alkoxycarbonyl group includes, for example, a tetradecanedioxycarbonyl group; the alkoxycarbonylamino group includes, for example, a dodecyloxycarbonylamino group; the alkoxy group includes, for example, a methoxy, ethoxy and octyloxy group. Of these, a preferred $R_B$ is an acylamino group located at the p-position with respect to $R_A$. And l is preferably 1.

Preferred compounds represented by Formula [M-I] of the invention are those exemplified below, but the embodiment of the invention is by no means limited to them.

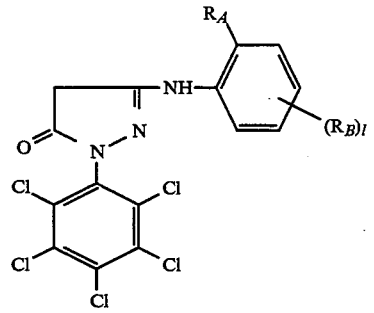

| Compounds | $R_A$ | $(R_B)_l$ |
|---|---|---|
| M-1 | Cl | 5-NHCOCH$_2$O, C$_5$H$_{11}$(t), C$_5$H$_{11}$(t) |
| M-2 | Cl | 5-NHCOCHO(C$_2$H$_5$), C$_5$H$_{11}$(t), C$_5$H$_{11}$(t) |
| M-3 | Cl | 5-NHCOCHO((i)C$_3$H$_7$), C$_5$H$_{11}$(t), C$_5$H$_{11}$(t) |
| M-4 | Cl | 5-NHCOCHO(C$_4$H$_9$), C$_5$H$_{11}$(t), C$_5$H$_{11}$(t) |
| M-5 | Cl | 5-NHCO(CH$_2$)$_3$O, C$_5$H$_{11}$(t), C$_5$H$_{11}$(t) |
| M-6 | Cl | 5-NHSO$_2$C$_{16}$H$_{33}$ |

-continued

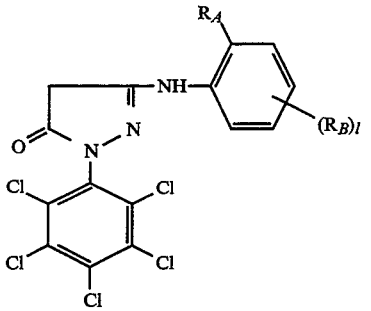

| Compounds | $R_A$ | $(R_B)_l$ |
|---|---|---|
| M-7 | Cl | 5-$NHSO_2$— 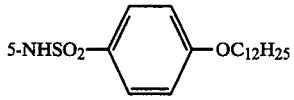 —$OC_{12}H_{25}$ |
| M-8 | $OCH_3$ | 5-$NHSO_2C_{12}H_{25}$ |
| M-9 | Cl | 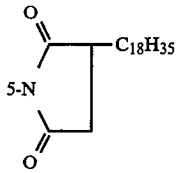 |
| M-10 | Cl | 5-$NHCOC_{13}H_{27}$ |
| M-11 | $OCH_3$ | 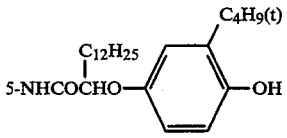 |
| M-12 | Cl | 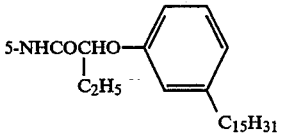 |
| M-13 | Cl | 5-$CONHC_{12}H_{25}$ |
| M-14 | Cl | 5-$SO_2N(C_8H_{17})_2$ |
| M-15 | Cl | 4-$OC_8H_{17}$, 5-$OC_8H_{17}$ |
| M-16 | Cl | 5-$COOC_{12}H_{25}$ |
| M-17 | Cl | 5-$NHCOCH(CH_3)CH_2SO_2C_{12}H_{25}$ |
| M-18 | Cl | 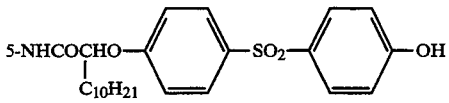 |
| M-19 | Cl | 5-$NHCOOC_{12}H_{25}$ |
| M-20 | Cl | 5-$OC_{12}H_{25}$ |

These mgenta couplers [M-I] can be synthesized by the general method for synthesizing 1-phenyl-5-pyrazolone compounds disclosed, for example, in U.S. Pat. Nos. 2,369,489, 2,376,380, 2,472,581, 2,600,788, 2,933,391, 3,615,506, British Pat. Nos. 956,261, 1,134,329 and Japanese Pat. Exam. Pub. No. 20636/1970.

A typical example of magenta coupler [M-I] synthesis is described below:

Synthesis example (synthesis of exemplified compound M-5)

To 75 ml of ethyl acetate were added 1.2 g of 1-pentachlorophenyl-3-(2-chloro-5-aminoanilino)-5-pyrazolone and 20 ml of water dissolving 2.7 g of sodium acetate, and the solution was stirred for 1 hour. Then, 9.2 g of 4-(2,4-di-t-pentylphenoxy)butanoyl chloride dissolved in 25 ml of ethyl acetate was added thereto in 10 minutes. After being stirred for 3 hours, the reaction liquor was allowed to stand, and the aqueous layer was removed. The ethyl acetate layer was washed with 50 ml of water, then the ethyl acetate was distilled away under reduced pressure. Recrystallization of the residue from toluene gave 12.8 g of the white crystalline objective compound having a melting point of 125°–127° C. The product was identified as exemplified compound M-5 on the basis of mass, NMR and IR spectra.

Magenta coupler [M-I] can be used in an amount of $1\times10^{-3}$ to 1 mol, preferably $1\times10^{-2}$ to $8\times10^{-1}$ mol per mol of silver halide.

Next, the colored magenta coupler of the invention represented by Formula [CM-I] (hereinafter referred to as colored magenta coupler [CM-I]) is described.

In Formula [CM-I], the substituent represented by $R_1$ includes, for example, an alkyl group, an alkoxy group, an aryl group, an acylamino group, a sulfonamido group, a hydroxyl group, a halogen atom, an alkoxycarbonyl group, an acyl group, a carbamoyl group, a sulfamoyl group and a carboxyl group, each of which may further have a substituent. $R_1$ is preferably an alkyl group, an alkoxy group, a hydroxyl group or an acylamino group. Particularly preferred is an alkoxy group.

The acylamino group represented by $R_2$ includes, for example, a 2,4-di-t-pentylphenoxyacetamido group and a 4-(2,4-di-t-pentylphenoxy)butaneamido group; the sulfonamido group includes, for example, a 4-dodecyloxyphenylsulfonamido group; the imido group includes, for example, an octadecenylsuccinimido group; the carbamoyl group includes, for example, a 4-(2,4-di-t-pentylphenoxy)butylaminocarbonyl group; the sulfamoyl group includes, for example, a tetradecanesulfamoyl group; the alkoxy group includes, for example, a methoxy group, an ethoxy group and an octyloxy group; the alkoxycarbonyl group includes, for example, a tetradecaneoxycarbonyl group; and the alkoxycarbonylamino group includes, for example, a dodecyloxycarbonylamino group. Preferred as $R_2$ is an acylamino group located at the p-position with respect to $R_3$.

The halogen atom represented by $R_3$ includes, for example, a chlorine atom, a bromine atom and a fluorine atom. The alkoxy group so-represented includes, for example, a methoxy group and an dodecyloxy group. Of them, a chlorine atom is particularly preferred as $R_3$. m is preferably 1 or 2, and n is preferably 1.

Typical examples of the compound represented by Formula [CM-I] of the invention are shown below, but the embodiment of the invention is not limited to them.

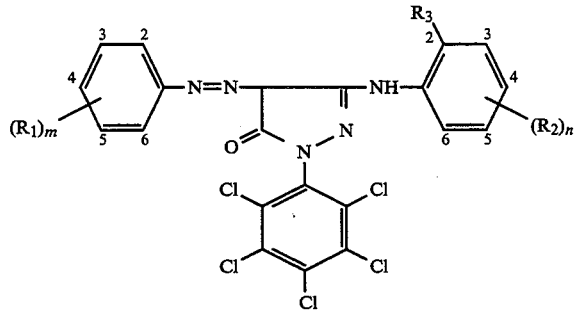

| Compounds | $(R_1)_m$ | $(R_2)_n$ | $R_3$ |
|---|---|---|---|
| CM-1 | 3-$OCH_3$, 4-$OCH_3$ | 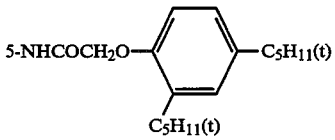 | —Cl |
| CM-2 | 3-$OCH_3$, 4-$OCH_3$ | 5-$NHCOC_{13}H_{27}$ | —Cl |
| CM-3 | 3-$OCH_3$, 4-$OCH_3$ | 4-$NHSO_2C_{16}H_{33}$ | —Cl |
| CM-4 | 3-$OCH_3$, 4-$OCH_3$ | 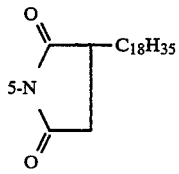 | —Cl |
| CM-5 | 3-$OCH_3$, 4-$OCH_3$ | 5-$NHSO_2C_{16}H_{33}$ | —Cl |
| CM-6 | 3-$OCH_3$, 4-$OCH_3$ | 5-$CONHC_{14}H_{29}$ | —Cl |
| CM-7 | 3-$OC_2H_5$, 4-$OC_2H_5$ | 5-$NHCOC_{13}H_{27}$ | —Cl |
| CM-8 | 3-$OC_2H_5$, 4-$OC_2H_5$ | 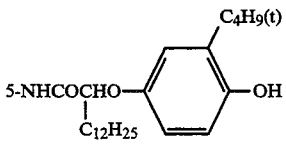 | —Cl |

-continued
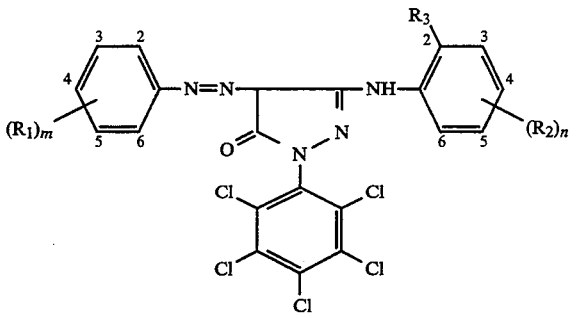
| Compounds | $(R_1)_m$ | $(R_2)_n$ | $R_3$ |
|---|---|---|---|
| CM-9 | 3-$OC_2H_5$, 4-$OC_2H_5$ | 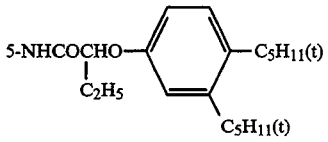 | —Cl |
| CM-10 | 3-$OC_2H_5$, 4-$OC_2H_5$ | 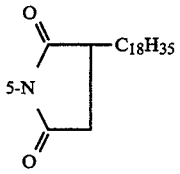 | —Cl |
| CM-11 | 3-$OC_2H_5$, 4-$OC_2H_5$ | 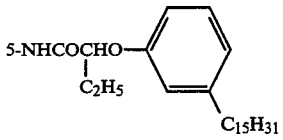 | —Cl |
| CM-12 | 4-$OCH_3$ | 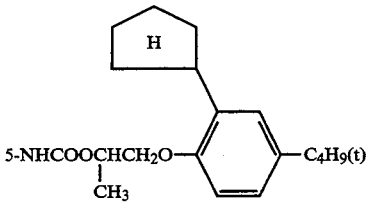 | —Cl |
| CM-13 | 4-$OCH_3$ | 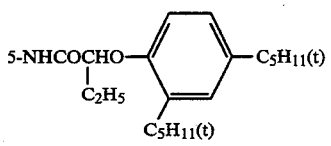 | —Cl |
| CM-14 | 4-$OCH_3$ | -($n_2$ = O) | —$OC_{12}H_{25}$ |
| CM-15 | 3-$CH_3$, 4-OH | 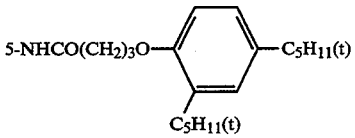 | —Cl |
| CM-16 | 3-$CH_3$, 4-OH | 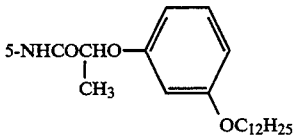 | —Cl |
| CM-17 | 4-OH | 5-$NHCOOC_{16}H_{33}$ | —Cl |
| CM-18 | 4-OH | 4-$OC_8H_{17}$, 5-$OC_8H_{17}$ | —Cl |

-continued
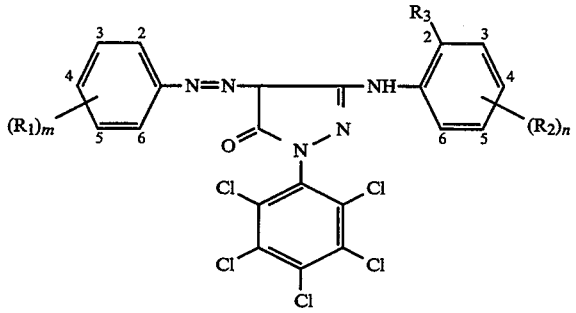
| Compounds | $(R_1)_m$ | $(R_2)_n$ | $R_3$ |
|---|---|---|---|
| CM-19 | 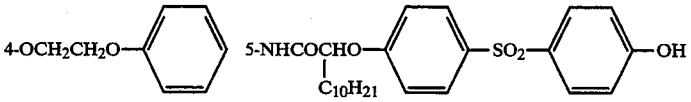 | | $-OCH_3$ |
| CM-20 | 4-$NHCOC_4H_9$(t) | 5-$NHCOC_{13}H_{27}$ | —Cl |
| CM-21 | 4-$NHCOC_4H_9$(t) | 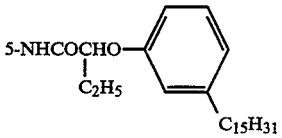 | —Cl |
| CM-22 | 3-$C_3H_7$(i), 4-$C_3H_7$(i) | 5-$COOC_{12}H_{25}$ | —Cl |
| CM-23 | 3-$C_3H_7$(i), 4-$C_3H_7$(i) | 4-$SO_2N(C_8H_{17})_2$ | —F |
| CM-24 | 3-$OCH_3$, 4-$OCH_3$ | 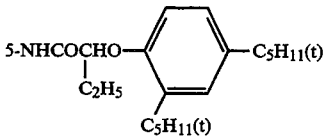 | —Cl |
| CM-25 | 3-$OC_2H_5$, 4-$OC_2H_5$ | 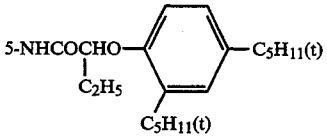 | —Cl |
| CM-26 | 4-$OC_2H_5$ | 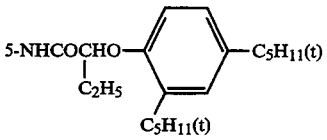 | —Cl |
| CM-27 | 4-$OC_3H_7$ | 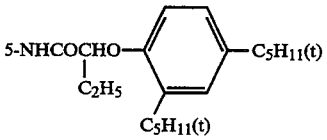 | —Cl |
| CM-28 | 4-$OC_4H_9$ | 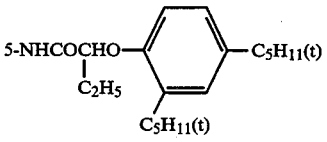 | —Cl |
| CM-29 | 4-$OCH_3$ | 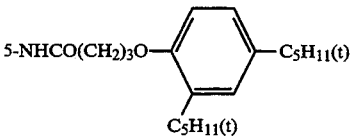 | —Cl |

-continued

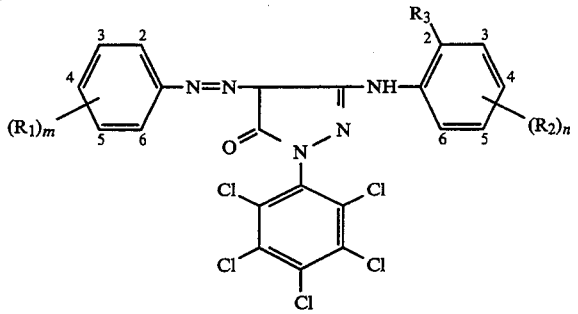

| Compounds | $(R_1)_m$ | $(R_2)_n$ | $R_3$ |
|---|---|---|---|
| CM-30 | 3-$OCH_3$, 4-$OCH_3$ | 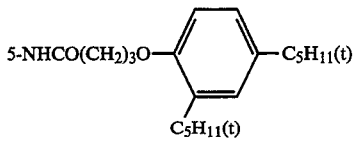 | —Cl |
| CM-31 | 3-$OC_2H_5$, 4-$OC_2H_5$ | 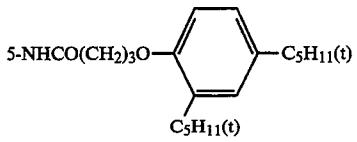 | —Cl |
| CM-32 | 4-$OC_2H_5$ | 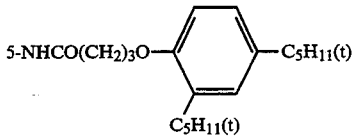 | —Cl |
| CM-33 | 4-$OC_3H_7$ | 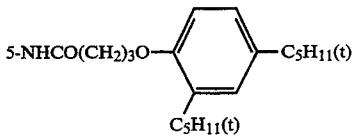 | —Cl |
| CM-34 | 4-$OC_4H_9$ | 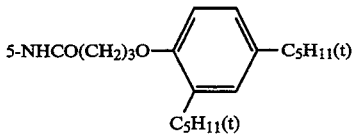 | —Cl |
| CM-35 | 4-$NHCOC_4H_9$(t) | 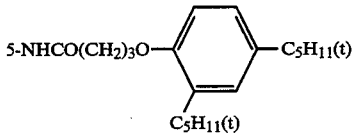 | —Cl |
| CM-36 | 4-OH | 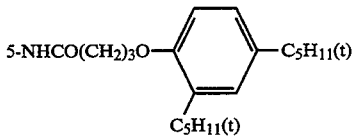 | —Cl |

Colored magenta coupler [CM-I] can be generally synthesized by the so-called diazo coupling reaction described, for example, in Japanese Pat. Exam. Pub. No. 6540/1981. That is, an aniline derivative is diazotized at 0° to −10° C. in water, a water containing alcohol or a water containing acetone by use of concentrated hydrochloric acid in moles 1 to 5 times those of the aniline derivative and sodium nitrite in moles 1 to 1.2 times those of aniline derivative, then this solution is added at −5° to −10° C. to a separately prepared pyridine solution dissolving the magenta coupler in an amount equimolar with that of the aniline derivative, so that diazo coupling takes place to give the desired colored coupler.

Next, typical synthesis examples of colored magenta coupler [CM-I] are described.

Synthesis example 1 (synthesis of CM-7)

To 3 ml of concentrated hydrochloric acid and 18 ml of water was added 1.4 g of 3,4-diethoxyaniline. The mixture was once heated for thorough dissolution and then cooled to −3°° C. Subsequently, 5.3 ml of 10% aqueous solution of sodium nitrite was added thereto, and the reaction liquor was stirred for 20 minutes at −3° C. to complete diazotization. Then, the excess nitrous acid was decomposed by adding 0.1 g of urea. Separately, 5.2 g of 1-(2,3,4,5,6-pentachlorophenyl)-3-(2-chloro-5-tetradecaneamidoanilino)-5-pyrazolone was dissolved in 100 ml of pyridine, and while the resulting solution was colored and stirred at −5°to −10° C. the above diazonium salt solution was added thereto slowly.

After 3 hours, the reaction liquor was poured into 400 ml of ice-cold water containing 100 ml of concentrated hydrochloric acid. The crystals deposited were filtered, washed with water, dried and then recrystallized from a mixture of ethyl acetate and acetonitrile. In this way, 5.5 g of CM-7 was obtained.

Synthesis example 2 (synthesis of CM-13)

A mixture of 3 ml of concentrated hydrochloric acid, 20 ml of water and 1.0 g of 4-methoxyaniline was once heated for dissolution and then cooled to −3° C. Subsequently, 5.3 ml of 10% aqueous solution of sodium nitrite was added to initiate diazotization. After stirring the solution for 20 minutes at −3° C., 0.1 g of urea was added thereto to decompose the excess nitrous acid.

Separately, 5.6 g of 1-(2,3,4,5,6-pentachlorophenyl)-3-{2-chloro-5-[α-2,4 di-t-amylphenoxy)-butaneamido]anilino}-5-pyrazolone was dissolved in 100 ml of pyridine. While the solution was colored and stirred at −5°to −10° C., the diazonium salt solution prepared as above was added slowly. After 3 hours, the reaction liquor was poured into 400 ml of ice-cold water containing 100 ml of concentrated hydrochloric acid. The crystals deposited were filtered, washed with water, dried and then recrystallized from a mixture of ethyl acetate and acetonitrile, giving 5.1 g of CM-13.

The structure of these compounds was identified on the basis of NMR and IR spectra.

Colored magenta coupler [CM-1] may be used singly or in combination of two or more kinds.

The addition amount of colored magenta coupler [CM-I] is not limitated, but it is preferably 1/20 to ½ tool per tool of magenta coupler [M-1] and can be varied with types or characteristics of silver halides, magenta couplers and colored magenta couplers used.

Magenta coupler [M-I ] and colored magenta coupler [CM-I ] can be incorporated in a silver halide emulsion layer by the conventional method, which comprises the steps of dissolving magenta coupler [M-I] and colored magenta coupler [CM-I], singly or in combination respectively, in a mixture of a high boiling solvent such as dibutyl phthalate or tricresyl phosphate and a low boiling solvent such as butyl acetate or ethyl acetate or in a low boiling solvent alone, mixing the solution with an aqueous solution of gelatin containing a surfactant, dispersing the resulting mixture by use of a high speed rotary mixer, a colloid mill or a supersonic disperser, and adding the dispersion directly to an emulsion. The above dispersion may also be added to an emulsion after being set, broken into parts and washed with water.

In the invention, magenta coupler [M-I] and colored magenta coupler [CM-I] may be separately dispersed by the above dispersing method and added to a silver halide emulsion, but preferably these are dissolved, dispersed and added together to an emulsion.

As a silver halide emulsion used in the light-sensitive material of the invention, any of conventional silver halide emulsions may be used. Such emulsions can be chemically sensitized in the usual manner and can be sensitized to a desired wavelength region by use of a sensitizing dye.

There may be contained in such emulsions an antifoggant and a stabilizer. Gelatin can be advantageously used as a binder for such emulsions.

The emulsion layer and other hydrophilic colloid layers may be hardened and, further, may contain a plasticizer and a latex of a water insoluble or sparingly soluble synthetic polymer. In the emulsion layer of the color photographic light-sensitive material, a coupler is contained.

In addition to the above, there may also be used a colored coupler having a color correction function, a competitive coupler and a compound which liberates, upon coupling with an oxidation product of a developing agent, a photographically useful fragment such as a development accelerator, a bleaching accelerator, a developer, a silver halide solvent, a toning agent, a hardener, a foggant, an antifoggant, a chemical sensitizer, a spectral sensitizer and a desensitizer.

In the light-sensitive material, auxiliary layers, such a filter layer, an antihalation layer and an anti-irradiation layer, may be provided. These layers and/or emulsion layers may contain a dye which is washed away from the light-sensitive material, or bleached out, in the course of development. The light-sensitive material may also contain a formalin scavenger, an optical whitening agent, a matting agent, a lubricant, an image stabilizer, a surfactant, an antistain agent, a development accelerator, a development retarder and a bleaching accelerator.

As the support, there may be used paper laminated with polyethylene, polyethylene terephthalate film, baryta paper and cellulose triacetate film.

The conventional color photographic process can be used to obtain dye images with the light-sensitive material of the invention.

EXAMPLES

Typical examples of the invention are described hereunder, but the embodiment of the invention is not limited to them.

Example 1

There was added 5 g of tricresyl phosphate and 15 ml of etyl acetate to 5 g of the magenta coupler of the invention (M-2). The mixture was then heated to 60° C. for thorough dissolution.

The solution was added to 50 ml of an aqueous solution kept at 40° C. and containing 6 g of gelatin and 0.5 g of sodium triisopropyl naphthalenesulfonate. Then, the mixture was dispersed with a high speed stirring by use of a homogenizer to obtain a finely dispersed coupler dispersion. The resulting coupler dispersion was set by being stored in a refrigerator at 5° C. for 3 weeks. After dispersing the coupler dispersion set as above by application of heat, 5 cc of that was coated and dried on a 10 cm×10 cm glass plate to obtain sample 101.

Sample 102 was prepared in the same way as sample 101, except that magenta coupler (M-2) was changed as shown in Table 1.

Sample 103 was prepared by the steps of adding 5 g of tricresyl phosphate and 15 ml of ethyl acetate to a mixture of 5 g of the above magenta coupler (M-2) and 1.5 g of the following colored magenta coupler (CM-a), heating the mixture to 60° C. for dissolution, adding the resulting solution to 50 ml of an aqueous solution of 40° C. containing 6 g of gelatin and 0.5 g of sodium triisopropyl naphthalenesulfonate, stirring it at a high speed with a homogenizer to obtain a fine coupler dispersion, storing the resulting coupler dispersion under the same conditions as those for sample 101, and then coating and drying it as mentioned above.

Samples 104 to 110 were prepared in the same manner as with sample 103, except that magenta coupler (M-2) and colored magenta coupler (CM-a) were changed as shown in Table 1.

The surfaces of samples 101 to 110 were microscopically examined to find out the state of oil particles dispersed and if there were any deposition of coupler crystals. The results obtained are shown in Table 1.

As apparent from Table 1, combination of the magenta coupler of the invention and the colored magenta coupler of the invention gave an excellent dispersion stability and did not deposit crystals at all in the course of aging.

TABLE 1

CM-a

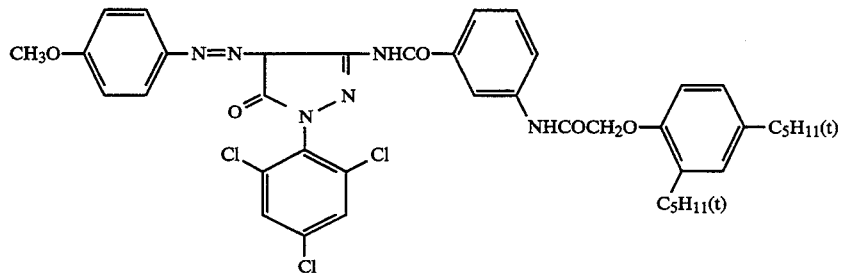

CM-b

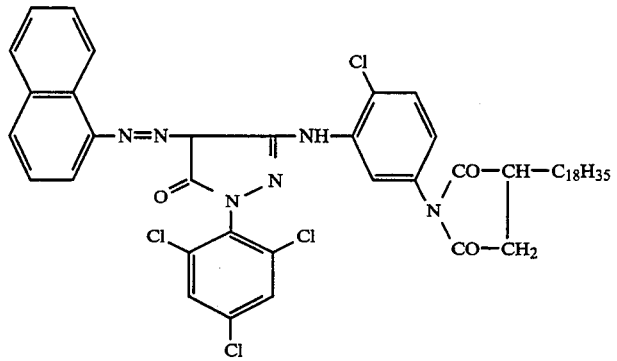

| Sample No. | Magenta Coupler | Colored Magenta Coupler | Results |
|---|---|---|---|
| 101 (comparison) | M-2 | — | Heavy deposition of crystallized coupler |
| 102 (comparison) | M-5 | — | Heavy deposition of crystallized coupler |
| 103 (comparison) | M-2 | CM-a | Fime coupler crystals deposited |
| 104 (comparison) | M-5 | CM-a | Fine coupler crystals deposited |
| 105 (comparison) | M-2 | CM-b | Fine coupler crystals deposited |
| 106 (comparison) | M-5 | CM-b | Fine coupler crystals deposited |
| 107 (invention) | M-2 | CM-1 | No coupler crystals deposited, good dispersion stability |
| 108 (invention) | M-5 | CM-1 | No coupler crystals deposited, good dispersion stability |
| 109 (invention) | M-2 | CM-29 | No coupler crystals deposited, good dispersion stability |
| 110 (invention) | M-5 | CM-29 | No coupler crystals deposited, good dispersion stability |

Example 2

In the examples described hereunder, the addition amount to a silver halide photographic light-sensitive material is expressed in grams per square meter unless otherwise indicated. The amount of silver halides and that of colloidal silvers are given in amounts of silver present. The amount of sensitizing dyes is expressed in moles per mole of silver.

A triacetylcellulose film support was subbed on one side (the surface) and then sequentially coated on the other side (the back side) with the layers of the following compositions, so that a subbed and back-coated support was prepared. The addition amount is given by weight per square meter.

| | |
|---|---|
| Back side 1st layer | |
| Alumina sol AS-100 (aluminium oxide made by Nissan Chemical Ind., Ltd.) | 0.1 g |
| Diacetylcellulose | 0.2 g |
| Back side 2nd layer | |
| Diacetylcellulose | 100 mg |
| Stearic acid | 10 mg |
| Silica fine particles (average size: 0.2 μm) | 50 mg |

sample 201, a multilayer color phortographic material, was prepared by forming sequentially the layers of the following compositions on the subbing layer of the above triacetylcellulose film support.

| | |
|---|---|
| 1st layer: antihalation layer (HC) | |
| Black colloidal silver | 0.15 |
| UV absorbent (UV-1) | 0.20 |
| Compound (CC-1) | 0.02 |
| High boiling solvent (Oil-1) | 0.20 |
| High boiling solvent (Oil-2) | 0.20 |
| Gelatin | 1.6 |
| 2nd layer: intermediate layer (IL-1) | |
| Gelatin | 1.3 |
| 3rd layer: | |
| low-speed red-sensitive emulsion layer (R-L) | |
| Silver iodobromide emulsion (average grain size: 0.3 μm) (average iodide content: 2.0 mol %) | 0.4 |
| Silver iodobromide emulsion (average grain size: 0.4 μm) (average iodide content: 8.0 mol %) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (D-1) | 0.006 |
| DIR compound (D-2) | 0.01 |
| High boiling solvent (Oil-1) | 0.55 |
| Gelatin | 1.0 |
| 4th layer: | |
| high-speed red-sensitive emulsion layer (R-H) | |
| Silver iodobromide emulsion (average grain size: 0.7 μm) (average iodide content: 7.5 mol %) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (D-2) | 0.02 |
| High boiling solvent (Oil-1) | 0.25 |
| Gelatin | 1.0 |
| 5th layer: intermediate layer (IL-2) | |
| Gelatin | 0.8 |
| 6th layer: | |
| low-speed green-sensitive emulsion layer (G-L) | |
| Silver iodobromide emulsion (average grain size: 0.4 μm) (average iodide content: 8.0 mol %) | 0.6 |
| Silver iodobromide emulsion (average grain size: 0.3 μm) (average iodide content: 2.0 mol %) | 0.2 |

-continued

| | |
|---|---|
| Sensitizing dye (S-4) | $6.7 \times 10^{-4}$ |
| Sensitizing dye (S-5) | $0.8 \times 10^{-4}$ |
| Magenta coupler (M-a) | 0.35 |
| Colored magenta coupler (the above CM-a) | 0.05 |
| DIR compound (D-3) | 0.02 |
| High boiling solvent (Oil-2) | 0.7 |
| Gelatin | 1.0 |
| 7th layer: | |
| high-speed green-sensitive emulsion layer (G-H) | |
| Silver iodobromide emulsion (average grain size: 0.7 μm) (average iodide content: 7.5 mol %) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-a) | 0.20 |
| Colored magenta coupler (the above CM-a) | 0.02 |
| DIR compound (D-3) | 0.004 |
| High boiling solvent (Oil-2) | 0.35 |
| Gelatin | 1.0 |
| 8th layer: yellow filter layer (YC) | |
| Yellow colloidal silver | 0.1 |
| Additive (SC-1) | 0.12 |
| High boiling solvent (Oil-2) | 0.15 |
| Gelatin | 1.0 |
| 9th layer: | |
| low-speed blue-sensitive emulsion layer (B-L) | |
| (Silver iodobromide emulsion) (average grain size: 0.3 μm) (average iodide content: 2.0 mol %) | 0.25 |
| Silver iodobromide emulsion (average grain size: 0.4 μm) average iodide content: 8.0 mol %) | 0.25 |
| Sensitizing dye (S-9) | $5.8 \times 10^{-4}$ |
| Yellow coupler (Y-1) | 0.6 |
| Yellow coupler (Y-2) | 0.32 |
| DIR compound (D-1) | 0.003 |
| DIR compound (D-2) | 0.006 |
| High boiling solvent (Oil-2) | 0.18 |
| Gelatin | 1.3 |
| 10th layer: | |
| high-speed blue-sensitive emulsion layer (B-H) | |
| Silver iodobromide emulsion (average grain size: 0.8 μm) (average iodide content: 8.5 mol %) | 0.5 |
| Sensitizing dye (S-10) | $3 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High boiling solvent (Oil-2) | 0.05 |
| Gelatin | 1.0 |
| 11th layer: 1st protective layer (PRO-1) | |
| Silver iodobromide emulsion (average grain size: 0.08 μm) | 0.3 |
| UV absorbent (UV-1) | 0.07 |
| UV absorbent (UV-2) | 0.10 |
| High boiling solvent (Oil-1) | 0.07 |
| High boiling solvent (Oil-2) | 0.07 |
| Formalin scavenger (HS-1) | 0.1 |
| Formalin scavenger (HS-2) | 0.1 |
| Formalin scavenger (HS-3) | 0.2 |
| Gelatin | 0.8 |
| 12th layer: 2nd protective layer (PRO-2) | |
| Compound A | 0.04 |
| Compound B | 0.004 |
| Polymethylmethacrylate (average particle size: 3 μm) | 0.02 |
| Methyl methacrylate:ethyl methacrylate:methacrylic acid 3:3:4 (weight ratio) copolymer (average particle size: 3 μm) | 0.13 |
| Gelatin | 0.5 |

Sample 201 further contained compounds Su-1 and Su-2, viscosity regulator, hardeners H-1 and H-2, stabilizer ST-1, antifoggants AF-1 and AF-2 (weight average molecular weights were 10,000 and 1,100,000, respectively) and dyes AI-1 and AI-2.

C-1
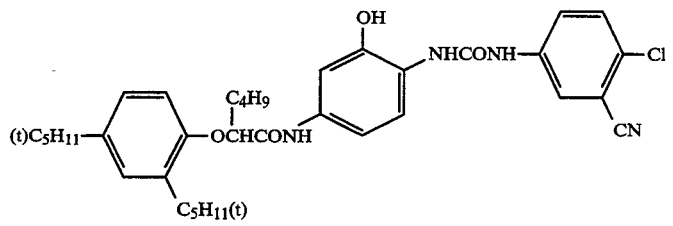
C-2
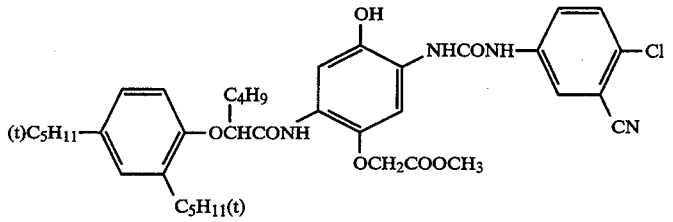
M-a
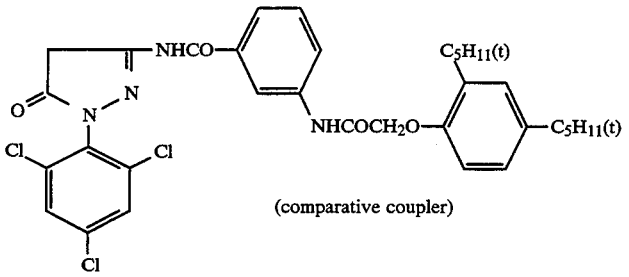
(comparative coupler)
Y-1
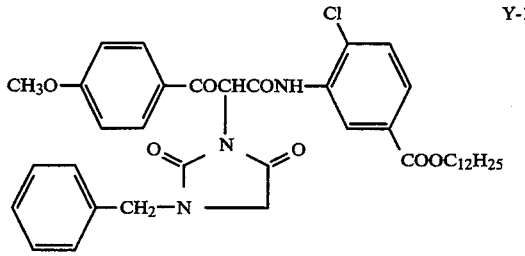
Y-2
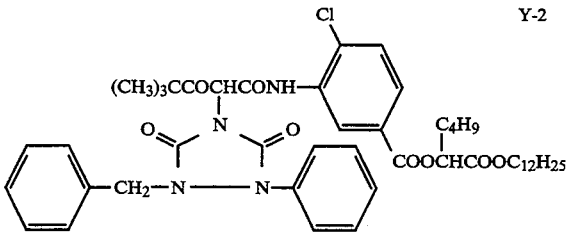
CC-1
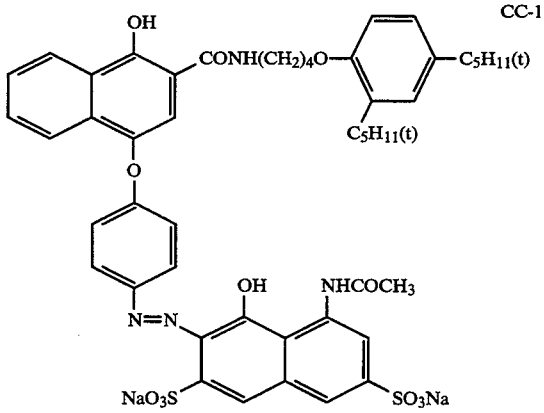
D-1
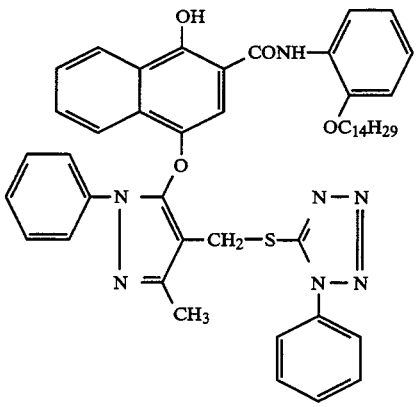

-continued
D-2
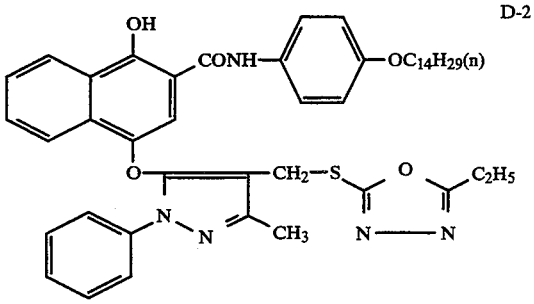
D-3
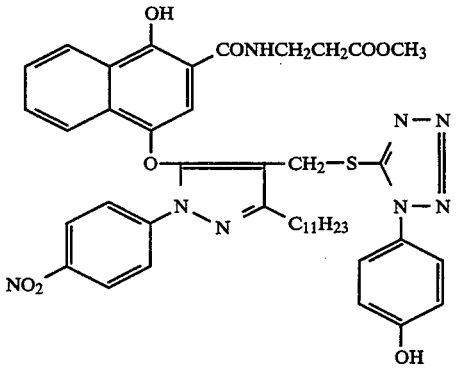
UV-1
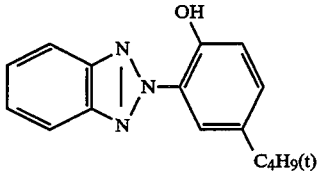
UV-2
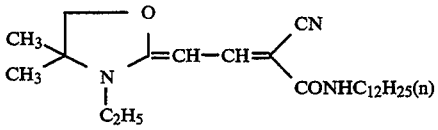
S-1
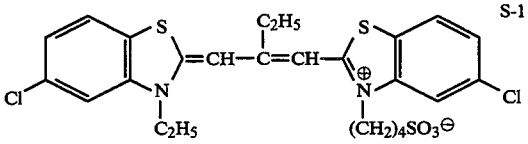
S-2
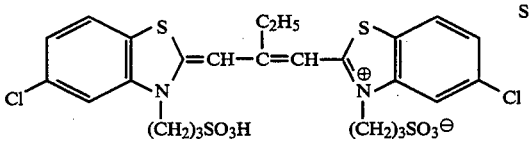
S-3
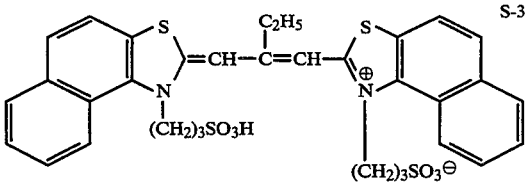
S-4
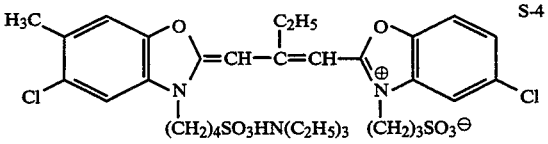
S-5
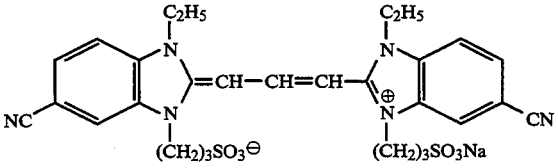
S-6
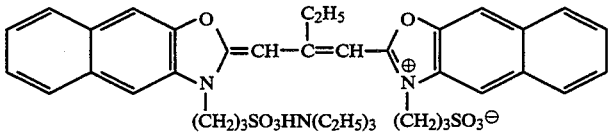
S-7
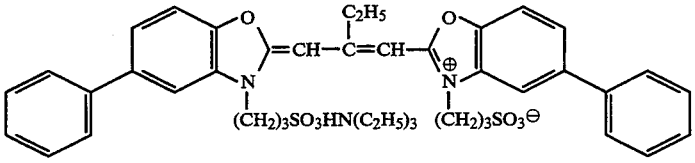
S-8
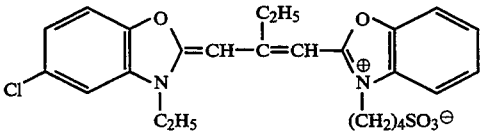
S-9
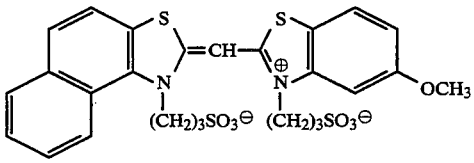

-continued
S-10
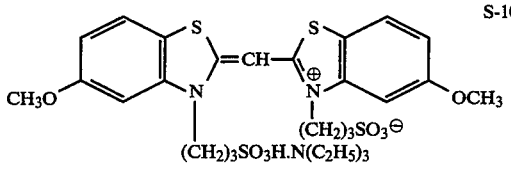
S-11
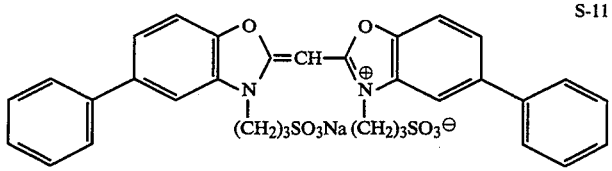
SC-1
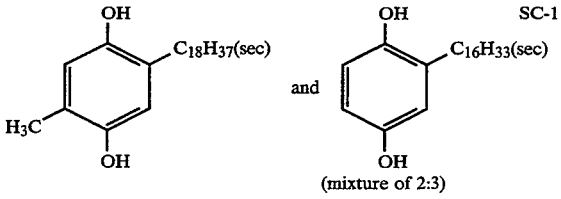
HS-1
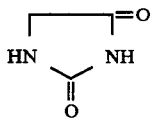
HS-2
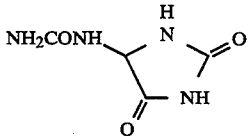
HS-3
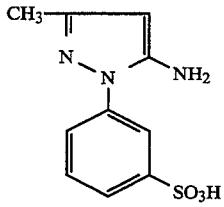
Oil-1
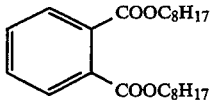
Oil-2
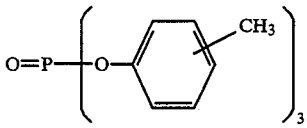
Oil-3
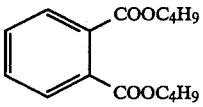
H-1
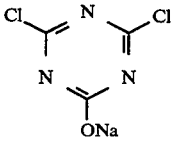
H-2
$CH_2{=}CHSO_2CH_2OCH_2SO_2CH{=}CH_2$
SU-1
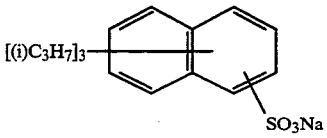
SU-2
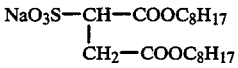
AI-1
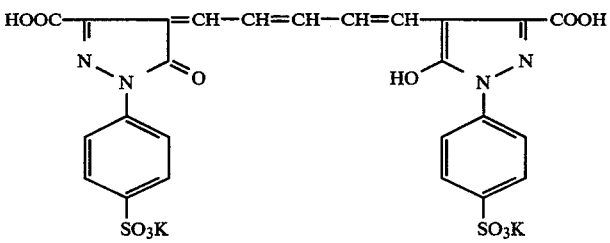
AI-2
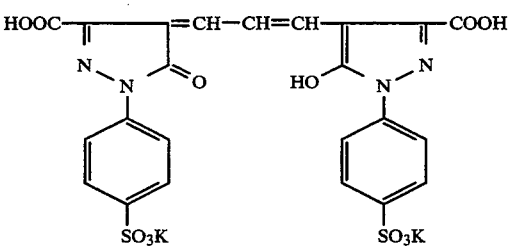
ST-1
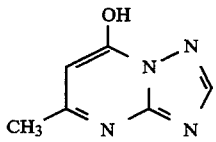

-continued

AF-1

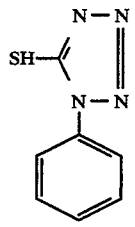

AF-2

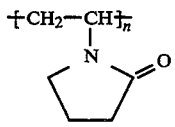

Compound A

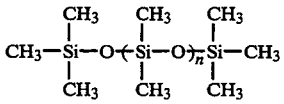

Mw = 30,000 (weight-average molecular weight)

Compound B

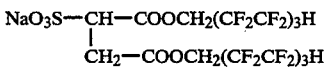

Next, samples 202 to 218 were prepared in the same way as sample 201, except that the magenta coupler and the colored magenta coupler added in the 6th and 7th silver halide emulsion layers were changed as shown in Table 2.

The amounts of the magenta coupler and the colored magenta coupler added in samples 202 to 218 were equimolar with those in sample 201.

TABLE 2

M-b (comparative coupler)

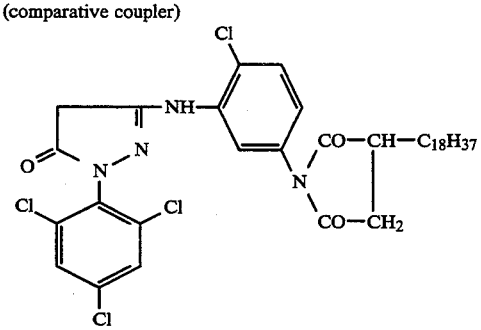

| | 6th Layer | | 7th Layer | |
|---|---|---|---|---|
| Sample No. | Magenta Coupler | Colored Magenta Coupler | Magenta Coupler | Colored Magenta Coupler |
| 201 (comparison) | M-a | CM-a | M-a | CM-a |
| 202 (comparison) | M-a | CM-b | M-a | CM-b |
| 203 (comparison) | M-b | CM-b | M-b | CM-b |
| 204 (comparison) | M-2 | CM-a | M-2 | CM-a |
| 205 (comparison) | M-2 | CM-b | M-2 | CM-b |
| 206 (comparison) | M-5 | CM-b | M-5 | CM-b |
| 207 (invention) | M-2 | CM-1 | M-2 | CM-1 |
| 208 (invention) | M-2 | CM-29 | M-2 | CM-29 |
| 209 (invention) | M-5 | CM-1 | M-5 | CM-1 |
| 210 (invention) | M-5 | CM-10 | M-5 | CM-10 |
| 211 (invention) | M-5 | CM-26 | M-5 | CM-26 |
| 212 (invention) | M-5 | CM-29 | M-5 | CM-29 |
| 213 (invention) | M-5 | CM-32 | M-5 | CM-32 |
| 214 (invention) | M-8 | CM-29 | M-8 | CM-29 |
| 215 (invention) | M-9 | CM-29 | M-9 | CM-29 |
| 216 (invention) | M-11 | CM-29 | M-11 | CM-29 |
| 217 (invention) | M-13 | CM-29 | M-13 | CM-29 |
| 218 (invention) | M-18 | CM-29 | M-18 | CM-29 |

Each of samples 201 to 218 thus prepared was exposed to green light through an optical step wedge for sensitometry and then processed under the following conditions:

TABLE 3

| Process | Processing Time | Processing Temp. | Replenishing Rate* |
|---|---|---|---|
| Color developing | 3 min 15 sec | 38 ± 0.3° C. | 780 ml |
| Bleaching | 45 sec | 38 ± 2.0° C. | 150 ml |
| Fixing | 1 min 30 sec | 38 ± 2.0° C. | 830 ml |
| Stabilizing | 60 sec | 38 ± 5.0° C. | 830 ml |
| Drying | 1 min | 55 ± 5.0° C. | — |

(*Replenishing rate is a value per $m^2$ of light-sensitive material)

The following color developer, bleach, fixer, stabilizer and replenishers thereof were used:

| | |
|---|---|
| Color developer | |
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 g |
| Hydroxylamine sulfate | 2.5 g |
| Sodium chloride | 0.6 g |
| 4-Amino-3-methyl-N-ethyl-N-(β-hydroxyethyl) aniline sulfate | 4.5 g |
| Diethylenetriaminepentacetic acid | 3.0 g |
| Potassium hydroxide | 1.2 g |
| Water was added to make 1 liter, then the pH was adjusted to 10.06 with potassium hydroxide or 20% sulfuric acid. | |
| Color developing replenisher | |
| Water | 800 ml |
| Potassium carbonate | 35 g |
| Sodium hydrogencarbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxyethyl) aniline sulfate | 6.3 g |
| Potassium hydroxide | 2 g |
| Diethylenetriaminepentacetic acid | 3.0 g |
| Water was added to make 1 liter, then the pH was adjusted to 10.18 with potassium hydroxide or 20% sulfuric acid. | |
| Bleach | |
| Water | 700 ml |
| Ammonium ferric 1,3-diaminopropanetetracetate | 125 g |
| Ethylenediaminetetracetic acid | 2 g |
| Sodium nitrate | 40 g |
| Ammonium bromide | 150 g |
| Glacial acetic acid | 40 g |
| Water was added to make 1 liter, then the pH was adjusted to 4.4 with aqueous ammonia or glacial acetic acid. | |
| Bleaching replenisher | |
| Water | 700 ml |
| Ammonium ferric 1,3-diaminopropanetetracetate | 175 g |
| Ethylenediaminetetracetic acid | 2 g |
| Sodium nitrate | 50 g |
| Ammonium bromide | 200 g |

-continued

| | |
|---|---|
| Glacial acetic acid | 56 g |
| The pH was adjusted to 4.0 with glacial acetic acid or aqueous ammonia, then water was added to make 1 liter. | |
| Fixer | |
| Water | 800 ml |
| Ammonium thiocyanate | 120 g |
| Ammonium thiosulfate | 150 g |
| Sodium sulfite | 15 g |
| Ethylenediaminetetracetic acid | 2 g |
| After adjusting the pH to 6.2 with glacial acetic acid or aqueous ammonia, water was added to make 1 liter. | |
| Fixing replenisher | |
| Water | 800 ml |
| Ammonium thiocyanate | 150 g |
| Ammonium thiosulfate | 180 g |
| Sodium sulfite | 20 g |
| Ethylenediaminetetracetic acid | 2 g |
| After adjusting the pH to 6.5 with glacial acetic acid or aqueous ammonia, water was added to make 1 liter. | |
| Stabilizer and stabilizing replenisher | |
| Water | 900 ml |
| $C_8H_{17}$—(C6H4)—O(CH2CH2O)10—H | 2.0 g |
| Dimethylolure | 0.5 g |
| Hexamethylenetetramine | 0.2 g |
| 1,2-Benzisothiazoline-3-one | 0.1 g |
| Siloxane (L-77 made by Union Carbide Corp.) | 0.1 g |
| Aqueous ammonia | 0.5 ml |

Water was added to make 1 liter, then the pH was adjusted to 8.5 with aqueous ammonia or 50% sulfuric acid.

After processing, sensitometry characteristics of green light were examined for each sample.

The sensivity was determined by the reciprocal of the exposure necessary to give a density of fog+0.3 and shown in Table 4 as a value relative to the sensitivity of sample 201, which was set at 100.

Next, each sample was stored for 14 days at a temperature of 50° C. and 80% relative humidity, then the density after storing was measured to compare it with the density before storing.

The measurement was made at an exposure point to give a density of 1.5 in sensitometry, and the density change (ΔD) between the sample before storing and that after storing was determined. The results are shown in Table 4.

Further, samples 201 to 218 were evaluated for color reproducibility in the following procedure. First, a color checker made by Macbeth Co. was photographed using each sample and a camera (Model FT-1MOTOR made by Konica Corp.). After subjecting the sample to color development (CNK-4 made by Konica Corp.), the resulting negative image was printed on Konica Color Paper Type QA in a size of 82 mm×117 mm by use of a Konica Color Printer Model CL-P2000 (made by Konica Corp.) to obtain a print. The printing conditions were adjusted for each sample in order that the gray color on the color checker might give the same gray color on the print. The print obtained was visually evaluated for color reproducibility. The results are shown in Table 4.

TABLE 4

| Sample No. | Sensitivity | ΔD | Color Reproducibility* |
|---|---|---|---|
| 201 (comparison) | 100 | 0.02 | B |
| 202 (comparison) | 107 | 0.04 | D |
| 203 (comparison) | 127 | 0.09 | E |
| 204 (comparison) | 115 | 0.17 | B |
| 205 (comparison) | 124 | 0.14 | C |
| 206 (comparison) | 125 | 0.13 | C |
| 207 (invention) | 122 | 0.02 | A |
| 208 (invention) | 121 | 0.03 | A |
| 209 (invention) | 122 | 0.02 | A |
| 210 (invention) | 124 | 0.02 | A |
| 211 (invention) | 122 | 0.01 | A |
| 212 (invention) | 125 | 0.01 | A |
| 213 (invention) | 123 | 0.02 | A |
| 214 (invention) | 120 | 0.02 | A |
| 215 (invention) | 119 | 0.01 | A |
| 216 (invention) | 121 | 0.03 | A |
| 217 (invention) | 121 | 0.02 | A |
| 218 (invention) | 120 | 0.02 | A |

*A sensory test by ten panelists.

A: excelent, B: good, C: slightly poor, D: poor, E: bad

AS apparent from the results in Table 4, combination of the magenta coupler of the invention and the colored magenta coupler of the invention can give a high sensitivity, a dye image considerably less in color change due to aging, and a good color reproduction.

What is claimed is:

1. A silver halide color photographic light sensitive material comprising a support having thereon a silver halide emulsion layer, wherein said silver halide emulsion layer contains a magenta coupler represented by Formula M-I and a colored magenta coupler represented by Formula CM-I;

Formula M-I

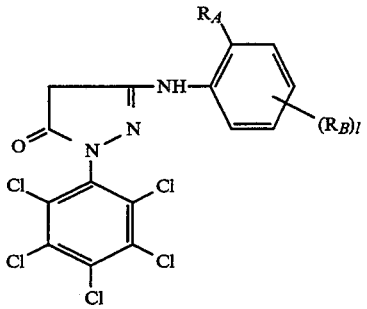

wherein $R_A$ represents a halogen atom or an alkoxy group; $R_B$ represents an acylamino group, a sulfonamido group, an imido group, a carbamoyl group, a sulfamoyl group, an alkoxycarbonyl group, an alkoxycarbonylamino group or an alkoxy group; and l represents an integer of 0 to 4;

Formula CM-I

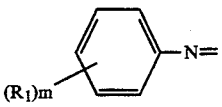

-continued

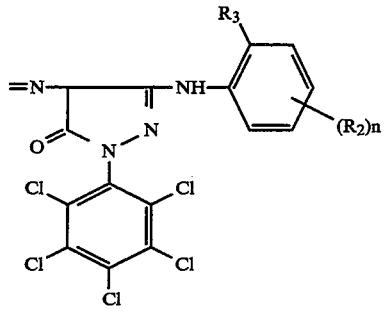

wherein R1 represents an alkyl group, an alkoxy group, an aryl group, an acylamino group, a sulfonamido group, a hydroxyl group, a halogen atom, and alkoxycarbonyl group, an acyl group, a carbamoyl group, a sulfamoyl group and a carboxyl group, each of which may have a substituent; R2 represents an acylamino group, a sulfonamido group, an imido group, a carbamoyl group, a sulfamoyl group, an alkoxy group, an alkoxycarbonyl group or an alkoxycarbonylamino group; $R_3$ represents a halogen atom or an alkoxy group; m represents an integer of 0 to 5; and n represents an integer of 0 to 4.

2. A color photographic material of claim 1 wherein said magenta coupler is contained in an amount of $1\times10^{-3}$ to 1 mol per mol of silver halide.

3. A color photographic material of claim 2 wherein said magenta coupler is contained in an amount of $1\times10^{-2}$ to $8\times10^{-1}$ mol per mol of silver halide.

4. A color photographic material of claim 1 wherein in Formula M-I, $R_A$ is a chlorine atom, $R_B$ is an acylamino group located at the para-position with respect to $R_A$, and l is 1.

5. A color photographic material of claim 1 wherein said colored magenta coupler is contained in an amount of 1/20 to ½ mol per mol of said magenta coupler.

6. A color photographic material of claim 1 wherein $R_1$ is an alkyl group, an alkoxy group, a hydroxyl group or an acylamino group.

7. A color photographic material of claim 6 wherein $R_1$ is an alkoxy group, $R_2$ is an acylamino group located at the para-position with respect to $R_3$,$R_3$ is a chlorine atom, m is 1 or 2, and n is 1.

* * * * *

UNITED STATES PATENT AND TRADEMARK OFFICE

CERTIFICATE OF CORRECTION

PATENT NO. : 5,364,753

DATED : November 15, 1994

INVENTOR(S) : Yamazaki et al.

It is certified that error appears in the above-identified patent and that said Letters Patent is hereby corrected as shown below:

Claim 1, col. 31, line 15, "R1" should read --$R_1$--; and line 20, "R2" should read --$R_2$--.

Signed and Sealed this

Second Day of May, 1995

*Attest:*

*Attesting Officer*

BRUCE LEHMAN

*Commissioner of Patents and Trademarks*